US005951011A

United States Patent [19]

Potter et al.

[11] Patent Number: 5,951,011

[45] Date of Patent: Sep. 14, 1999

[54] METHOD OF PROGRESSIVE JACKPOT GAMING

[76] Inventors: Bruce Henri Potter; Deborah Jean Potter, both of P.O. Box 305, Surfside, Calif. 90743

[21] Appl. No.: 08/903,234

[22] Filed: Jul. 18, 1997

[51] Int. Cl.[6] ..... A63F 1/00

[52] U.S. Cl. ..... 273/292; 463/13; 463/26; 463/27

[58] Field of Search ..... 273/292, 274, 273/309; 463/12, 13, 26, 27

[56] References Cited

U.S. PATENT DOCUMENTS

| | | | |
|---|---|---|---|
| 4,837,728 | 6/1989 | Barrie et al. | 273/143 R |
| 4,861,041 | 8/1989 | Jones et al. | 273/292 |
| 5,288,077 | 2/1994 | Jones | 273/292 |
| 5,364,105 | 11/1994 | Jones | 273/292 |
| 5,377,973 | 1/1995 | Jones | 273/292 |
| 5,393,067 | 2/1995 | Paulsen et al. | 273/292 |
| 5,417,430 | 5/1995 | Breeding | 273/292 |

OTHER PUBLICATIONS

"Stud Poker", Scarne's Encyclopedia Of Games, Harper & Row, Publishers, pp. 33–38, 1973.

*Primary Examiner*—Benjamin H. Layno

[57] ABSTRACT

Methods of Progressive Jackpot gaming are disclosed, wherein players are offered multiple chances to enter into a Progressive Jackpot wagering game each hand. Players are offered an initial Progressive Jackpot wagering opportunity prior to any cards being dealt, and are then offered subsequent wagering opportunities as they receive portions of their hand. A portion of each Progressive Jackpot wager is set aside for the Super Progressive Jackpot. The amount of the Super Progressive Jackpot, plus the amount of the Progressive Jackpot will be awarded to a player with the highest Progressive Jackpot hand rank (i.e. a Royal Flush) if that player placed a Progressive Jackpot wager at every offered opportunity.

10 Claims, 4 Drawing Sheets

METHOD OF PROGRESSIVE JACKPOT GAMING

BACKGROUND

1. Field of Invention

The present invention pertains to the field of Progressive Jackpot gaming. More specifically, this relates to a method of playing a Progressive Jackpot game which can be played in conjunction with wagering table games that are played in casinos and cardrooms throughout the world.

2. Description of Prior Art

Many casinos and cardrooms throughout the world have been combining Progressive Jackpot wagering games with a variety of table games. Progressive Jackpot wagering games are characterized by offering a one time wager which may be placed prior to the deal of the game that offer large payouts if an extremely hard to reach combination of cards is achieved, i.e. a Royal Flush in poker. Other Progressive Jackpot wagering games require that the casino or "house" set aside a portion of the amounts won from the players for the Progressive Jackpot. The large payouts associated with Progressive Jackpot wagering games can be a fixed amount or a Progressive amount. The fixed amount will pay a predetermined dollar amount, i.e. $50,000 for a Royal Flush, no matter how many Progressive Jackpot wagers have been placed. The Progressive method pays a predetermined percentage of the total of all Progressive Jackpot wagers, i.e. 100% for a Royal Flush, 15% for a Straight Flush, etc. and all amounts not paid each hand carry over to the next hand. These Progressive Jackpot wagering games add a high degree of excitement to the table games, provide a potential of high returns for players, and are major profit centers for casinos. Currently, however, players have only one opportunity to participate in the Progressive Jackpot wagering game during each hand; that one opportunity is before any cards have been dealt. These Progressive Jackpots cause a degree of frustration, because the players must place the Progressive Jackpot wager only prior to receiving any portion of their hand, in order to participate in any part of the Progressive Jackpot wagering game. Most of the time, the players will find that their hand is no where near achieving the requirement for a Progressive Jackpot payout. A large number of wagering game players do not participate in the current Progressive Jackpot games, because they know the odds of achieving a qualifying hand are heavily against them, before seeing any cards. Some players also feel a sense of disappointment if another player at the table achieves a Progressive Jackpot payout; they feel that they should be entitled to a portion.

Progressive Jackpot wagering games that are combined with regular table games are known. U.S. Pat. No. 4,861,041 (to Jones et. al.) discloses a method to combine a Progressive Jackpot wagering game with many table games. U.S. Pat. No. 5,417,430 (to Breeding) discloses a method to combine a Progressive Jackpot wagering game with a modified version of 5-card stud poker. The aforementioned patents, however, only allow a player one option of entering into the Progressive Jackpot game; that single option is offered prior to the player viewing any portion of their hand. All current Progressive Jackpot gaming methods are designed with either a one time Progressive Jackpot wager which is placed prior to viewing any cards, wherein the casino will take a portion of the Progressive Jackpot wager for administrative costs, or a mandatory Progressive Jackpot wager which is part of the player's wager, wherein no additional wager is required because the Progressive Jackpot is based on a percentage of the total amount wagered on the table game and is, therefore, paid from the casinos' profit from the table game. The full potential of added excitement and player satisfaction that can be provided by Progressive Jackpot games has not yet been realized by these current Progressive Jackpot games.

All players would welcome the option of entering into a Progressive Jackpot wagering game after viewing a portion of their hand. Many players would find a Progressive Jackpot wagering game even more exciting if it allowed multiple Progressive Jackpot wagers during each hand, with even larger possible payouts. Players who currently do not play these Progressive Jackpot wagering games would participate if given the opportunity to view a portion of their hand prior to placing a Progressive Jackpot wager, and others would participate more than once every hand. Casinos would receive greater profit from a Progressive Jackpot wagering game that allowed players multiple opportunities to participate.

OBJECTS AND ADVANTAGES

It is an object of the present invention to provide an improved Progressive Jackpot wagering game that can be combined with a large variety of table games designed for use in casinos and cardrooms.

It is a feature of the present invention where a participant in a Progressive Jackpot wagering game is offered more than one opportunity to enter into the Progressive Jackpot wagering game, with one opportunity being offered prior to any cards being dealt and subsequent opportunities being offered as the players view their cards. This is an advantage over the prior art in the field since this will add an enhanced level of excitement, increase potential winnings, and increase income potential for the casino.

It is an advantage of the present invention that players can now view a portion of their hand prior to placing a Progressive Jackpot wager. This gives the player the opportunity to wait for a hand that has the potential to reach a Progressive Jackpot hand rank, before placing a jackpot wager, thereby reducing the risk and increasing the value to the player.

Still further objects and advantages will become apparent from a consideration of the ensuing detailed description.

REFERENCE NUMERALS

Figure 1:
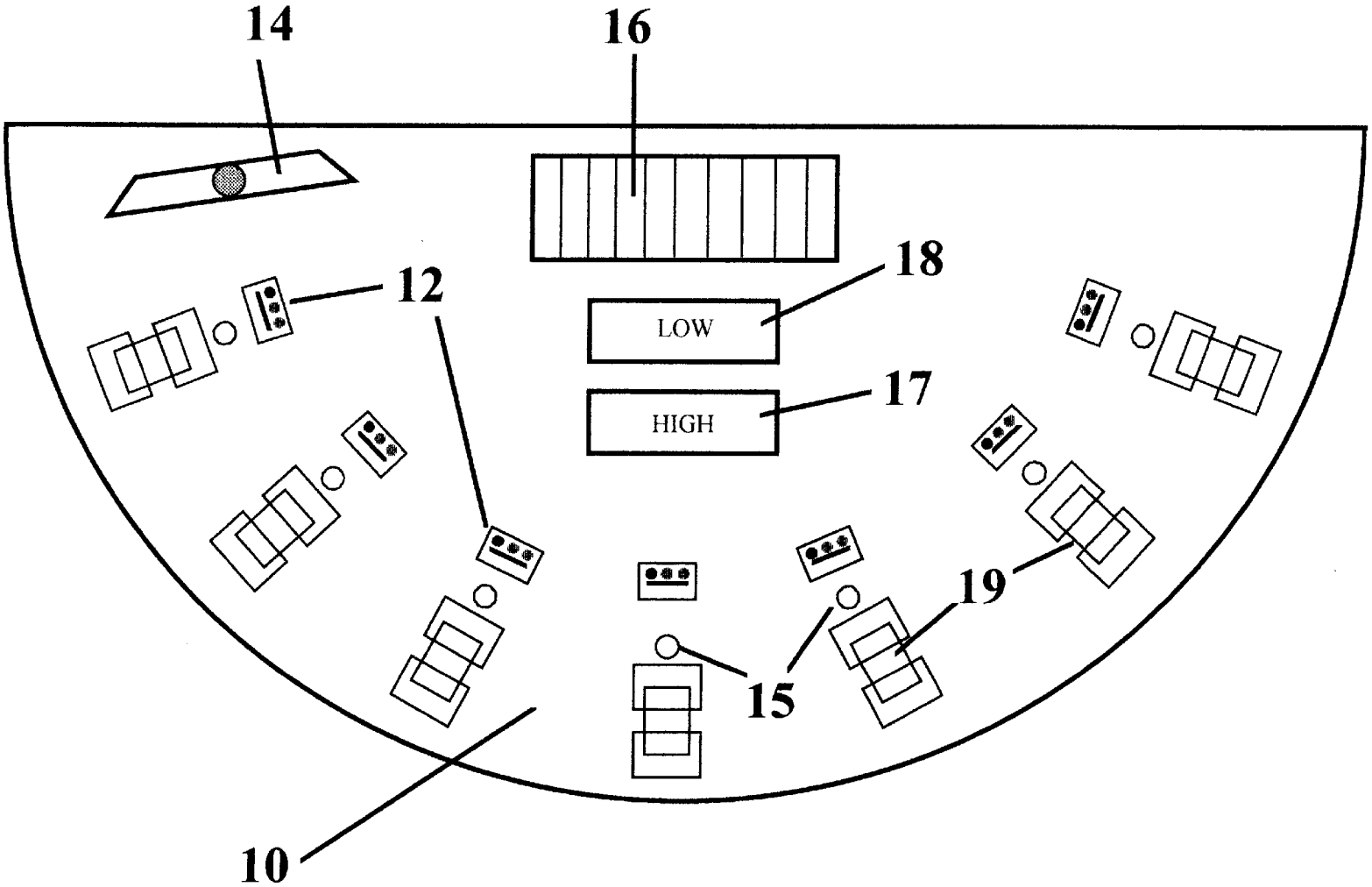
FIG. 1 shows the top view of a standard gaming table surface with Progressive Jackpot meter readout, and coin acceptors at each player location that would be useful for the preferred embodiment of the present invention.

10 playing surface
12 coin acceptor
14 dual jackpot meter readout
15 wagering circle
16 chip rack
17 bank High hand box
18 bank Low hand box
19 player station
20 initial wager indication light
22 subsequent wager indication light

24 coin acceptor slot
30 Progressive Jackpot readout
32 Super Progressive Jackpot readout
40 through 60 flow chart items

SUMMARY

The present invention is a Progressive Jackpot wagering game that can be combined with many regular table games including Blackjack, Baccarat, Brag, Caribbean Stud™, Casino War™, Chemin De Fer, Let it Ride™, Faro, Five-card draw poker, Five-card stud poker, Hi/Low split poker, Lowball poker, Monte, Pai Gow poker, Pai Gow tiles, Panguine, Red Dog, Seven-card stud poker, Seven-and-a-Half, Super Pan-Nine, Three Card Poker™, Western Stud™, and others. Like other Progressive Jackpot wagering games, the present invention offers each player the option of entering into the Progressive Jackpot, by wagering a gaming token (typically one dollar ($1,)) prior to any cards being dealt. Each token that is wagered is added to the Progressive Jackpot, with the house deducting a predetermined amount for administrative costs. But, unlike all other Progressive Jackpot wagering games, the present invention provides the players with one or more opportunities to enter the Progressive Jackpot wagering game, after viewing portions of their hand. Each player is offered a number of subsequent wagering opportunities regardless of whether or not they entered into the Progressive Jackpot wagering game before viewing a portion of their hand. Each subsequently wagered token will be added to the Progressive Jackpot in the same manner as the initial Progressive Jackpot wager. Other embodiments allow players the opportunity to enter into the Progressive Jackpot wagering game only after viewing portions of their hand, with no initial Progressive Jackpot wager.

The present invention will offer a number of subsequent wagering opportunities with a cumulative payout potential, giving players the opportunity to win more than 100% of the amount allocated to the Progressive Jackpot. Each Progressive Jackpot wager will be allocated with a portion set aside for the Super Progressive Jackpot, the Super Progressive Jackpot will consist of the Progressive Jackpot money plus the amount set aside for the Super Progressive Jackpot. The preferred apparatus of the present invention will be comprised of the standard gaming tables used with Progressive Jackpot wagering games, wherein coin acceptors are built into the gaming table and electronically connected to a Progressive Jackpot meter. The meter's readout will differ from typical Progressive Jackpot wagering games as it will have two readouts; one will display the amount of the Progressive Jackpot, and the other will display the highest amount that a player can win, (the Super Progressive Jackpot.) Some of the embodiments, however, wherein the players place wagers only after viewing portions of their hand, may utilize the current single readout meters.

DETAILED DESCRIPTION

Figure 2:
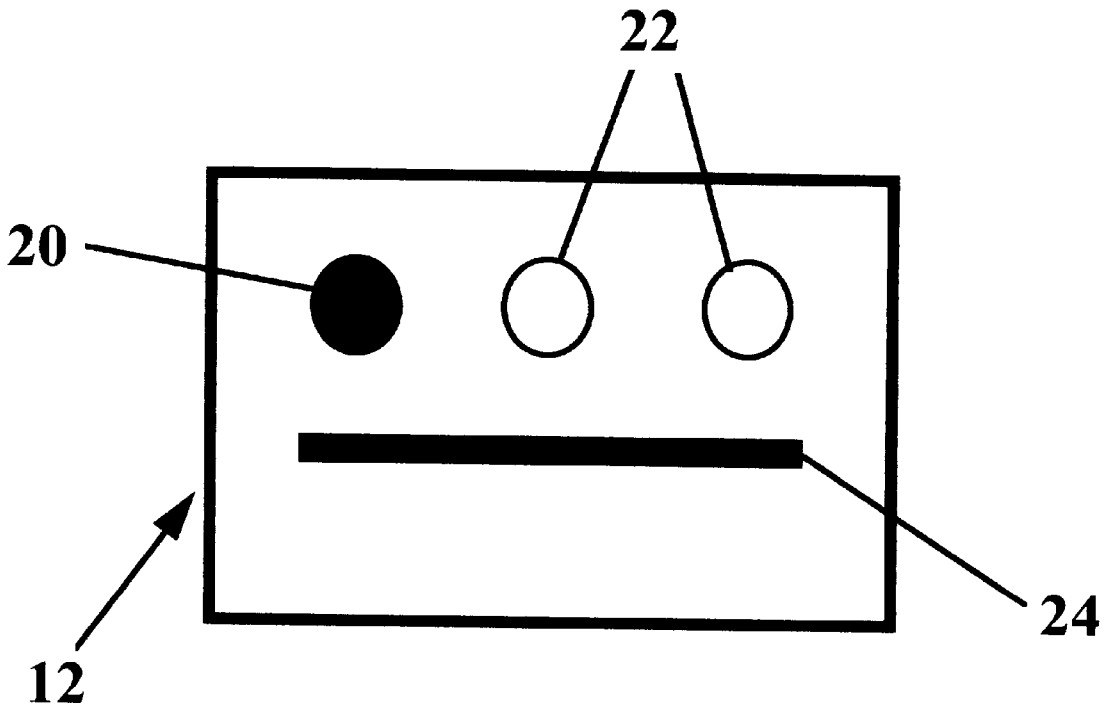
FIG. 2 shows a close up view of a coin acceptor.
Figure 3:
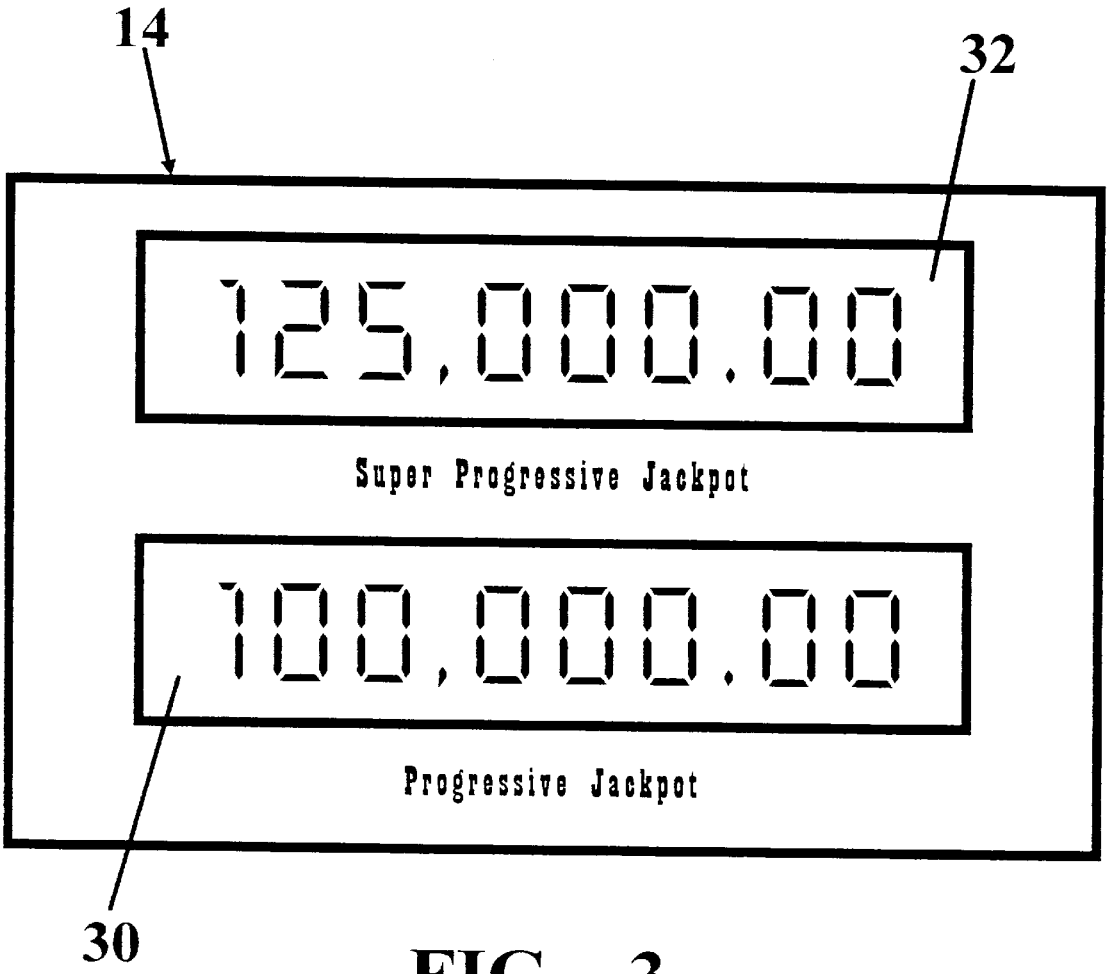
FIG. 3 shows the face of a jackpot meter readout device that would be useful for the present invention.

The preferred embodiment of the present invention is a modified version of High/Low poker, a game that is protected by and described within U.S. Pat. No. 5,494,295 to (Potter et. al., applicant) is combined with a Progressive Jackpot wagering game. As shown in FIG. 1, a gaming table 10 is provided with a coin acceptor 12 directly above a player station 19 of which there are seven, each of which include a wagering circle 15. Each coin acceptor 12 will be connected to a jackpot meter (not shown) that will have a dual jackpot meter readout 14, coin acceptor 12 and dual jackpot meter readout 14 are shown in greater detail in FIGS. 2 & 3 respectively and are more fully explained herein. A dealer will be positioned behind a chip rack 16. The game of the preferred embodiment utilizes two dealer hands, a standard poker hand and a lowball poker hand. The dealer will place these hands in a bank High hand box 17, and a bank Low hand box 18 respectively. As shown in FIG. 2, each coin acceptor 12 includes a initial wager indication light 20 and two of a subsequent wager indication light 22, as well as a coin acceptor slot 24. As shown in FIG. 3, dual jackpot meter readout 14 includes two readouts, possibly LCD, a Progressive Jackpot readout 30, and a Super Progressive Jackpot readout 32.

Figure 4:
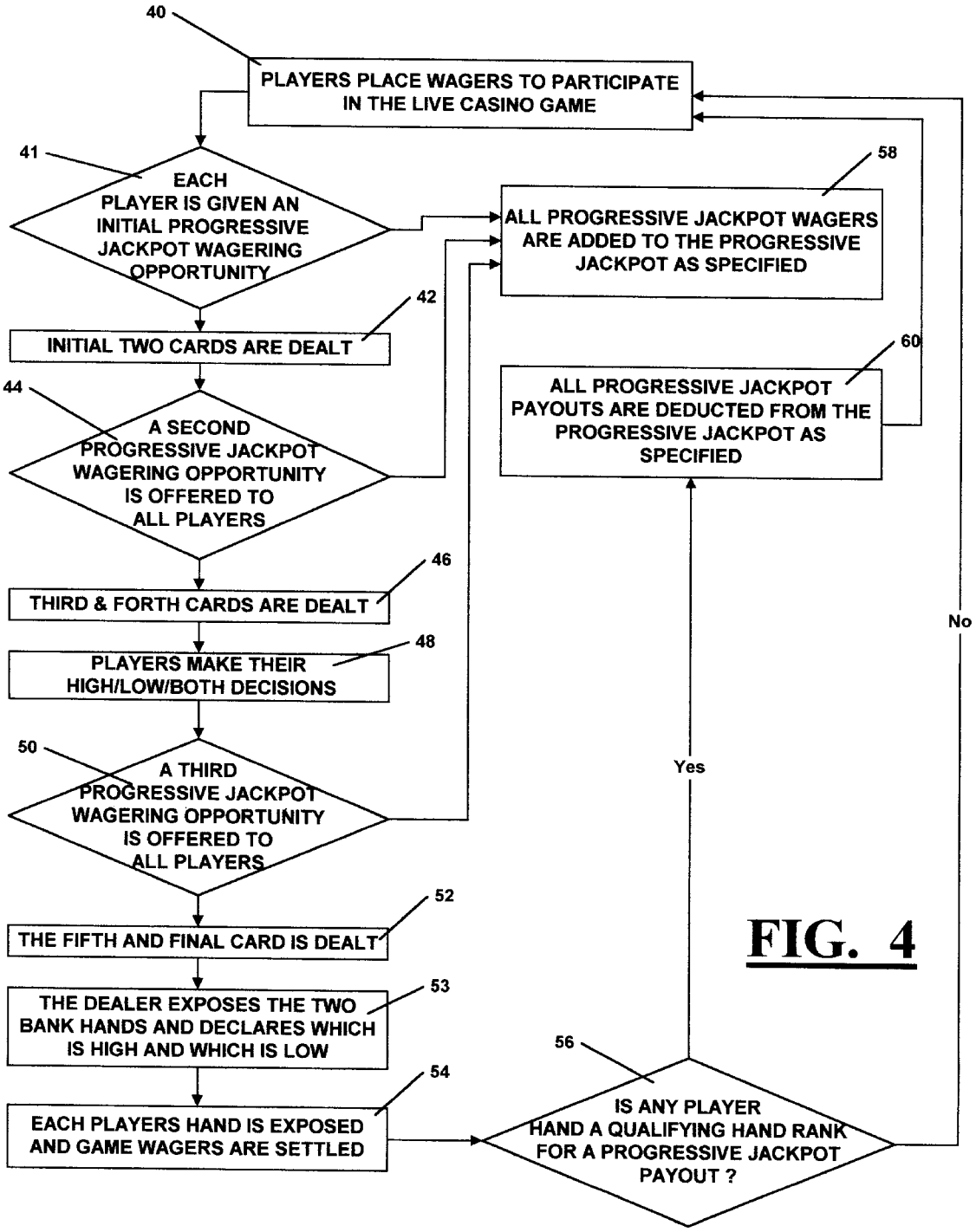
FIG. 4 is a flow chart showing the operation of the preferred embodiment of the present invention.

The preferred embodiment of the present invention operates as shown in FIG. 4 as follows. Each player places a wager in wagering circle 15 to participate in the live casino game, block 40. Each player is given an option to place an initial Progressive Jackpot wager, decision block 41. Each player that decides to place the initial Progressive Jackpot wager will place a token into coin acceptor slot 24 prior to any cards being dealt; this will activate initial wager indication light 20. All Progressive Jackpot wagers will be added to the Progressive Jackpot as specified herein, block 58. Each player is now dealt their initial two cards, block 42, and is given their first subsequent Progressive Jackpot wagering opportunity, decision block 44. As these first subsequent Progressive Jackpot wagers are placed into coin acceptor slot 24 the first of subsequent wager indication light 22 will activate. As the Progressive Jackpot wagers are placed, they are added to the Progressive Jackpot as specified herein, block 58. Once all players have decided whether or not to place the first subsequent wager, the dealer will deal out the third and fourth cards to each player, block 46. Each player now must decide which of the bank hands to play their hand against, (the High hand (standard poker,) the Low hand (lowball poker,) or both hands,) and place their four cards face down in the corresponding box within player station 19, block 48. The second subsequent Progressive Jackpot wagering opportunity is now offered to the players, decision block 50. As these second subsequent Progressive Jackpot wagers are placed in coin acceptor slot 24 the second of subsequent wager indication light 22 will activate. Again, as the Progressive Jackpot wagers are placed, they are added to the Progressive Jackpot as specified herein, block 58. The last card is now dealt to each player, completing their hand, block 52. The dealer now exposes both of the bank hands, and according to a predetermined set of guidelines, declares which hand will play High, (standard poker,) and which hand will play Low (lowball poker.) The High hand is then placed in bank High hand box 17, and the Low hand is placed in bank Low hand box 18, block 53. Each player's complete five card hand is now exposed, compared to the specific bank hand the player chose to play against, (High, Low, or both,) and the wagers are settled, block 54. As the players hands are exposed, each player with at least one of initial Progressive Jackpot wager indication light 20 or subsequent Progressive Jackpot wager indication light 22 illuminated will have their hand compared to the list of qualifying Progressive Jackpot hand ranks, explained herein, decision block 56. If there are no qualifying Progressive Jackpot hand ranks, the next hand begins, block 40. If any hand qualifies for a Progressive Jackpot payout, the monetary amount of the Progressive Jackpot payout is determined, as explained herein, and the player with the qualifying hand is paid the determined amount. That amount is then deducted from the Progressive Jackpot as specified herein, block 60. The player with the qualifying hand is paid the determined monetary amount, and the next hand begins, block 40.

A predetermined list of hand ranks that qualify for a Progressive Jackpot payout percentage must be provided. The Progressive Jackpot hand ranks and payouts could be structured as follows:

TABLE A (Qualifying Hand Rank Payouts)

| Progressive Jackpot Hand Rank | Percentage of Progressive Jackpot |
|---|---|
| Royal Flush | 100% |
| "5" High Straight Flush | 60% |
| Straight Flush | 15% |
| 4 of a Kind | 1% |
| "5" High Straight | .5% |
| Full House | .25% |

Since the table game of the preferred embodiment utilizes two sets of rules, standard poker and lowball poker, payouts have been provided for hands that qualify in both sets. A "5" high straight, (Ace,2,3,4,5,) is the best hand that can be achieved in lowball poker, therefore payouts have been provided for this hand. The table game of the preferred embodiment will utilize one standard deck of 52 cards. If the "house" desires a Joker, or more than one Joker, may be added to the deck. Adding a Joker or Jokers will change the above payout chart.

Prior to the hands being dealt, and prior to each portion of the hands being dealt, each player will be given a sufficient amount of time to place a Progressive Jackpot wager. Each token that is wagered into coin acceptor 12 will result in the amount of the Progressive Jackpot, and the amounts shown on dual jackpot meter readout 14 to be increased by a predetermined amount for each token. A player with a qualifying hand rank that placed only the initial Progressive Jackpot wager is entitled to win 100% of the corresponding payout listed in Table A. Since players are given an opportunity to view a portion of their hand prior to placing a subsequent Progressive Jackpot wager, a player with a qualifying hand rank that placed only a subsequent wager is entitled to a smaller percentage of the corresponding payout listed in Table A. Therefore the following payout percentages have been provided:

TABLE B (Percentage of Qualifying Hand Rank Payout)

| Entered into Progressive Jackpot | Percentage of Table A Payout |
|---|---|
| initial wager | 100% |
| after 1st two cards | 20% |
| after 1st four cards | 5% |

Any player, however, that places the initial Progressive Jackpot wager and any subsequent Progressive Jackpot wagers should be entitled to more than 100% of the payouts listed in Table A. The above percentages, therefore, are a cumulative payout for all qualifying Progressive Jackpot hand ranks. A player who enters into the Progressive Jackpot at each and every opportunity (all three times,) whose hand achieves a qualifying Jackpot hand rank, would therefore be entitled to 125% of the payout listed in Table A. The 125% is the total of the percentages from Table B (100% for initial wager, 20% for first subsequent wager, and 5% for second subsequent wager.) Thus, a player with a Royal Flush that placed a Progressive Jackpot wager at every opportunity (all three,) would be entitled to a minimum payout of 125% of the Progressive Jackpot amount shown on Progressive Jackpot readout 30. A player that places a wager at every opportunity whose hand achieves a Royal Flush would be entitled to the full amount shown on Super Progressive Jackpot readout 32, which will always show an amount equal to or greater than 125% of the amount shown on Progressive Jackpot readout 30.

Therefore, the amount of the Progressive Jackpot that a player with a qualifying jackpot hand rank would be entitled to would be based on the rank of their hand and how many Progressive Jackpot wagers that the player placed. The following table (Table C) illustrates the percentage of the Progressive Jackpot that a player with a qualifying hand would be entitled:

TABLE C (Jackpot Payouts (%))

| | Qualifying Hand Rank | | | | | |
|---|---|---|---|---|---|---|
| Number of Jackpot Wagers | Royal Flush | "5" High Straight Flush | Straight Flush | 4 of a Kind | "5" High Straight | Full House |
| Initial only | 100 | 60 | 15 | 1 | .5 | .25 |
| Initial & 1st subsequent | 120 | 72 | 18 | 1.2 | .6 | .3 |
| Initial & 2nd subsequent | 105 | 63 | 15.75 | 1.05 | .525 | .2625 |
| Initial & 1st & 2nd subsequent | 100* | 75 | 18.75 | 1.25 | .625 | .3125 |
| 1st subsequent - no initial | 20 | 12 | 3 | .2 | .1 | .05 |
| 2nd subsequent - no initial | 5 | 3 | .75 | .05 | .025 | .0125 |
| 1st & 2nd subsequent - no initial | 25 | 15 | 3.75 | .25 | .125 | .0625 |

*This payout is a percentage of the Super Progressive Jackpot amount.

If a player places a Progressive Jackpot wager at every opportunity (all three,) and their hand achieves a Straight Flush, that player will be paid 18.75% of the amount displayed on Progressive Jackpot readout 30, which is equal to 125% of the 15% payout for a Straight Flush, (from Table A.) A player who wagers a token at every opportunity except the first (prior to the cards being dealt,) whose hand achieves a Royal Flush is entitled to 25% of the amount displayed on Progressive Jackpot readout 30. A player who wagers the initial token (prior to the cards being dealt,) and the second subsequent token, but not the first subsequent token, whose hand achieves a Royal Flush would be entitled to 105% of the amount displayed on Progressive Jackpot readout 30.

The present invention provides for what appear to be exceedingly high payouts. The wagered tokens, however, are not allocated in the same manner as the current Progressive Jackpot wagering methods. The game will utilize Progressive Jackpot meter (not shown) that will track and allocate every token that is wagered in the Progressive Jackpot game. Each token could be allocated into three separate accounts as follows:

TABLE D (Token Allocation)

| Percentage of Each Token Wagered | Allocation of Funds |
|---|---|
| 70% | Progressive Jackpot |
| 17.5% | Super Progressive Jackpot |
| 12.5% | casino administrative costs |

Progressive Jackpot meter (not shown) utilizes dual readout shown in FIG. 3. Progressive Jackpot readout 30 will display the Progressive Jackpot amount. Super Progressive Jackpot readout 32 will display the Super Progressive Jackpot amount which will be equal to the amount of the Super Progressive Jackpot account plus the amount of the Progressive Jackpot account. For each gaming token wagered into coin acceptor slot 24, Progressive Jackpot meter (not shown) will increase Progressive Jackpot readout 30 by 70% of the value of each gaming token wagered. Super Progressive Jackpot readout 32 will increase by 87.5% (70%+17.5%,) as outlined above, of the value of each gaming token wagered, which is equal to 125% of the 70% allocated to the Progressive Jackpot amount; representing the amount a player with a Royal Flush would win if they placed a Progressive Jackpot wager prior to any cards being dealt, as well as all subsequent Progressive Jackpot wagers. At all times, Super Progressive Jackpot readout 32 will display the sum of the amount shown on Progressive Jackpot readout 30 and the amount of the Super Progressive Jackpot account. All payouts are deducted from Progressive Jackpot account, with the exception of payouts over 100%. If a player achieves a payout of 105%, or 120%, the player will receive the amount on Progressive Jackpot readout 30, plus 5% or 20% respectively. This 5% or 20% will be deducted from the Super Progressive Jackpot account.

Following is an example of how the Super Progressive Jackpot operates. If a total of $50,000.00 worth of tokens has been wagered in the Progressive Jackpot wagering game and no Progressive Jackpot payouts have been distributed, Progressive Jackpot readout 30 will read $35,000.00, (70% of $50,000.00.) Super Progressive Jackpot readout 32 will read the sum of the Progressive Jackpot account plus the Super Progressive Jackpot account, a total of $43,750.00, (87.5% of $50,000.00.) The $43,750.00 breaks down as follows: $35,000.00 (70% of $50,000.00) is the amount of the Progressive Jackpot account and $8,750.00 (17.5% of $50,000.00) is the amount of the Super Progressive Jackpot account. If a player wagers a Progressive Jackpot token at every opportunity and their hand achieves a "5" High Straight Flush, which is not the Super Progressive Jackpot hand, that player will receive $24,500.00, (75% (from Table C above) of the amount on Progressive Jackpot readout 30.) Progressive Jackpot readout 30 would then be adjusted to read $10,500.00 ($35,000.00 (the original amount of the Progressive Jackpot account) −$24,500.00 (the amount paid.)) Super Progressive Jackpot readout 32 will be adjusted to read $19,250.00, ($10,500.00 (the new amount of the Progressive Jackpot account) +$8,750.00 (the amount of the Super Progressive Jackpot account.))

The "house" may opt to provide an initial amount of money called "seed" money to get the Progressive Jackpot started; this amount may vary. The payouts, percentages, and allocations, outlined above can be adjusted depending on preferences of the "house."

Alternate embodiments of the present invention combine the above described Super Progressive Jackpot wagering game with poker type wagering games wherein players wager against each other and the "house" charges the players either by the hour or by a percentage of the "pot," the total amount wagered. Poker type games utilize wagering rounds immediately after the players receive a card or cards, dealt directly to their own hand, or dealt as a community card or cards wherein each player is given the option of placing a wager, within predetermined limits. Each other player must either "call" the wager by wagering the same amount, "raise" the wager by wagering more than the same amount or "fold" their cards and forfeit all rights to the "pot."

One example, would be the game of 5-card stud poker. In this game each player is initially dealt two cards, one face down and one face up, followed by a wagering round. Next, each player that has not folded their cards receives three additional cards dealt singly, face up, each card being followed by a wagering round. In this embodiment, each player will be given an opportunity to place an initial Progressive Jackpot wager, prior to any cards being dealt. The dealer will then deal the first two cards, followed by a wagering round, and each player that has not folded their cards, will be given an opportunity to place a subsequent Progressive Jackpot wager, followed by additional subsequent Progressive Jackpot wagering opportunities after each wagering round, prior to the final wagering round.

The Progressive Jackpot payouts would be structured very differently from the above described preferred embodiment, because there are four Progressive Jackpot wagering opportunities, and only one set of hand ranking rules. The payout percentages could be structured as follows:

TABLE AA

Poker-type game Progressive Jackpot

| Jackpot Hand Rank | Percentage of Progressive Jackpot |
|---|---|
| Royal Flush | 100% |
| Straight Flush | 15% |
| 4 of a Kind | 1% |
| Full House | .5% |
| Flush | .25% |

The percentage of the Progressive Jackpot that a player would be entitled to could be as follows:

TABLE BB

Poker-type game Progressive Jackpot

| Entered into the Jackpot | Percentage Entitled |
|---|---|
| prior to any cards dealt | 100% |
| after 1st two cards | 40% |
| after 1st three cards | 10% |
| after 1st four cards | 5% |

The allocation of each gaming token could be as follows:

TABLE CC

Poker-type game Progressive Jackpot

| Percentage of Token | Allocation of Funds |
|---|---|
| 56% | Progressive Jackpot |
| 30.8% | Super Progressive Jackpot |
| 13.2% | casino administrative costs |

The "house" may also choose to eliminate the initial (prior to any cards dealt) Progressive Jackpot wagering opportunity from the game, and only utilize the subsequent Progressive Jackpot wagering opportunities after players receive their cards. Allowing players to wager into the Progressive Jackpot only after viewing a portion of their hand would dramatically change the percentage of the payouts, and the token allocation. The payout percentages for the table game used in the preferred embodiment could be adjusted as follows:

TABLE AAA

| No intitial Wager | |
|---|---|
| Entered into the Jackpot | Percentage Entitled |
| after 1st two cards | 100% |
| after 1st four cards | 10% |

The allocation of each gaming token could be adjusted to:

TABLE BBB

| No intitial Wager | |
|---|---|
| Percentage of Token | Allocation of Funds |
| 80% | Progressive Jackpot |
| 8% | Super Progressive Jackpot |
| 12% | casino administrative costs |

The Super Progressive Jackpot, in this game, would always be greater than or equal to 110% of the Progressive Jackpot amount. The Super Progressive Jackpot would only be awarded to a player with a Royal Flush that placed both Progressive Jackpot wagers.

Progressive Jackpot allows players a chance to enter into the Progressive Jackpot only after viewing a portion of their hand.

Other embodiments of the present invention will combine the Progressive Jackpot wagering game to games where the player is not dealt a set amount of cards. One example is Blackjack, were the players are each dealt two cards and are given the option to receive more cards. These optional cards are called "hit" cards. Each player is given an option to place the initial wager, prior to any cards being dealt, and subsequent wagers with each "hit" card. The Super Progressive Jackpot winning hand in this game could be Ace,2,3,4,5,6. This would allow for an initial Progressive Jackpot wager as well as up to four subsequent Progressive Jackpot wagers.

The afore mentioned games could utilize a one time Progressive Jackpot wager that is placed after the player views a portion of their hand. In this case there would be no Super Progressive Jackpot, a player with the top qualifying hand rank (i.e. a Royal Flush) would win 100% of the total value of all Progressive Jackpot wagers made minus the casino administrative costs.

A Progressive Jackpot such that has been demonstrated in the above embodiments could be combined with many different table games. The specific Progressive Jackpot hand ranks, payout percentages, number of subsequent wagers, and distribution of the Progressive Jackpot wagers will vary from game to game.

Conclusions, Ramifications, and Scope

Accordingly, it is apparent that the present invention provides a method whereby a casino or cardroom can offer their clientele a Progressive Jackpot method that is far more exciting and beneficial to the players, and the "house" than any of the Progressive Jackpot methods currently being offered.

Although the description above contains many specificities, these should not be construed as limiting the scope of the invention, but as merely providing illustrations of some of the presently preferred embodiments of this invention. For example, versions of the above described embodiments could be incorporated into electronic gaming devices, wherein the dealer would be replaced by electronic hardware and software.

Thus the scope of the invention should be determined by the appended claims and their legal equivalents, rather than by the examples given.

We claim:

1. A method of including or combining a jackpot wagering system in addition to a casino card game comprising the steps of:

a) providing at least one deck of playing cards;

b) a player placing a casino card game wager to participate only in said casino card game;

c) providing said player an option to place a progressive jackpot wager to participate only in said jackpot wagering system prior to viewing any cards;

d) dealing a portion of a complete card hand to said player, wherein said complete card hand being a maximum number of cards said player receives before settling said casino card game wager and ending the casino card game, providing said player a further option to place said progressive jackpot wager to participate only in said jackpot wagering system after viewing said portion of said complete card hand dealt by a dealer, wherein said progressive jackpot wager comprises a fixed monetary amount;

e) apportioning said fixed monetary amount of each said progressive jackpot wager into each one of a progressive jackpot and a super progressive jackpot through a predetermined allocation in said jackpot wagering system, and separately allocating said progressive jackpot and said super progressive jackpot from said casino card game wager; and f) dealing a remaining portion of said complete card hand, and ending said casino card game by settling said casino card game wager wherein either the player or the dealer winning said casino card game wager at the end of every casino card game; and g) if said player exercised said option and/or said further option and said complete card hand comprises a predetermined arrangement of cards, then said player wins a predetermined percentage of said progressive jackpot and/or said super progressive jackpot and deducting said predetermined percentage from said progressive jackpot and or said super progressive jackpot.

2. A method of including or combining a jackpot wagering system with a casino card game according to claim 1 wherein said player wins said predetermined percentage of said super progressive jackpot only if said player exercised said option and said further option.

3. A method of including or combining a jackpot wagering system with a casino card game according to claim 1 further comprising the step of said dealer dealing said player said portion of said card hand more than one time, and providing said player said further option at each interval that said portion is dealt.

4. A method of including or combining a jackpot wagering system with a casino card game according to claim 3 wherein said player can only win said predetermined percentage of said super progressive jackpot if said player exercised said option and every said further option.

5. A method of including or combining a jackpot wagering system with a casino card game according to claim 4 wherein said casino card game is Five Card Stud and said player is provided said further option three times.

6. A method of including or combining a jackpot wagering system with a casino card game according to claim 4 wherein said casino card game is Seven Card Stud and said player is provided said further option four times.

7. A method of including or combining a jackpot wagering system with a casino card game according to claim 4 wherein said casino card game is Texas Hold-Em and said player is provided said further option three times.

8. A method of including or combining a jackpot wagering system with a casino card game according to claim 4 wherein said casino card game is Blackjack and said player is provided said further option up to four times.

9. A method of including or combining a jackpot wagering system with a casino card game according to claim 3 wherein said casino card game is a video format and said dealer is replaced by a computerized software and hardware.

10. A method of including or combining a jackpot wagering system with a casino card game according to claim 1 wherein said casino card game is a video format and said dealer is replaced by a computerized software and hardware.

* * * * *